US005966887A

United States Patent [19]

Mieyal

[11] Patent Number: 5,966,887

[45] Date of Patent: Oct. 19, 1999

[54] SUSPENDED CEILING CROSS TEE END CONNECTOR

[75] Inventor: David F. Mieyal, Strongsville, Ohio

[73] Assignee: Bailey Metal Products Limited, Ontario, Canada

[21] Appl. No.: 08/927,033

[22] Filed: Sep. 10, 1997

[51] Int. Cl.[6] ..... E04B 2/00

[52] U.S. Cl. ..... 52/506.07; 52/664

[58] Field of Search ..... 52/506.06, 506.07, 52/506.08, 664–668

[56] References Cited

U.S. PATENT DOCUMENTS

| | | | |
|---|---|---|---|
| 4,108,563 | 8/1978 | Brown et al. | 403/347 |
| 4,499,697 | 2/1985 | LaLonde | 52/98 |
| 4,535,580 | 8/1985 | Shirey | 52/506.06 |
| 4,611,453 | 9/1986 | Worley | 52/667 |
| 4,648,230 | 3/1987 | Mieyal et al. | 52/667 |
| 4,712,350 | 12/1987 | Vukmanic | 52/506.06 |
| 4,779,394 | 10/1988 | Shirey et al. | 52/667 |
| 4,785,603 | 11/1988 | Platt | 52/667 |
| 4,794,745 | 1/1989 | Platt et al. | 52/506.06 |
| 4,827,681 | 5/1989 | Platt | 52/98 |
| 4,912,894 | 4/1990 | Platt | 52/98 |
| 4,989,387 | 2/1991 | Vukmanic et al. | 52/667 |
| 5,044,138 | 9/1991 | Zaccardelli | 52/667 |
| 5,154,031 | 10/1992 | Wall | 52/506.06 |
| 5,271,202 | 12/1993 | Vukmanic et al. | 52/667 |
| 5,517,796 | 5/1996 | Koski et al. | 52/506.07 |
| 5,687,525 | 11/1997 | Koski et al. | 52/506.06 X |
| 5,761,868 | 6/1998 | LaLonde et al. | 52/506.07 |

*Primary Examiner*—Beth Aubrey

*Attorney, Agent, or Firm*—Dennison, Meserole, Scheiner & Schultz

[57] ABSTRACT

The present invention is directed to an end connector for a cross tee for use in a suspended ceiling grid system. The end connector includes a front portion adapted to be inserted by a stab in motion into a vertical opening in a web of a main tee and a rear portion adapted to be attached to an end of a cross tee. The front portion has front, bottom and top edges with a first lock arrangement provided on a top edge of the front portion, the first lock region providing a connection between the end connector and a web of a main tee when the connector is inserted into an opening in a web of a main tee. The first lock arrangement extends angularly outwardly of the end connector and has a forward portion resiliently deflectable from its rest position to pass through an opening in a web of a main tee and then spring back to its rest position. A web containing area is located rearwardly of the forward portion for containing a web of a main tee and a stop surface is located rearwardly of the web containing area. The front portion of the end connector also has a second lock arrangement located within the body of the front portion for locking engagement with a complementary second lock arrangement of another end connector to interlock two such connectors inserted from opposite sides into an opening of a web of a main tee.

45 Claims, 11 Drawing Sheets

SUSPENDED CEILING CROSS TEE END CONNECTOR

FIELD OF THE INVENTION

The present invention relates to a grid for suspended ceilings, and in particular, to an improved end connector for cross tees forming part of the grid of such ceiling grid system.

BACKGROUND OF THE INVENTION

Suspended ceilings have been utilized in building installations for many years. They are typically provided as a grid work of main runners and cross runners suspended from the building structure and supporting suitable infill material such as ceiling tiles, light fixtures, air handling devices, etc. In most suspended ceilings the runners have the form of an inverted "T", and thus, are sometimes called main tee's and cross tee's. The grid tee's are usually formed from a strip of material which has been bent to form a bulb or bead along the top edge of a central web with opposed, outwardly extending flanges located at the bottom edge of the web. The flanges are generally covered by a cap strip to provide a finished appearance to the portion of the tee which is exposed to the room.

Suspended ceilings are generally formed by hanging main tee's along one dimension of a room, the main tee's being spaced apart a distance equal to the length of a cross tee which is typically four feet. The main tees are provided with openings at a regular spacing along the length of the main tee, the openings accepting an end connector located at the end of the cross tee for connecting the cross tee to the main tee. Typically opposed cross tees are interconnected within the opening, the opposed cross tees extending to either side of the web of the main tee. The connection between the cross tee and the main tee and between interconnected cross tees must, according to many present building code standards, be able to support the ceiling in an emergency situation, such as fire and seismic conditions. Thus, the suspended ceiling must provide sufficient integrity such that the connectors will not disengage when exposed to a fire, and also should have sufficient integrity so that in a seismic occurrence, such as an earth quake, the connections will be maintained to enable the infill material of the ceiling to be supported.

A variety of end connector designs have been proposed, the most common of which are stab-in type connectors shown in, for example, U.S. Pat. Nos. 4,108,563 4,611,453 and 4,601,153 amongst others. These stab-in type connectors utilize a tab lanced out of the side of the end connector to engage the side of the web of the main tee adjacent the opening and generally include an interlock to lock two of the end connectors together when placed through the opening from opposite sides of the web of the main tee. While these cross tee connectors were simple to install, in circumstances where it may be desirable to remove the end connector, such end connectors were not easily removed without causing damage to the end connector or the web of the main tee.

In recent years, a number of removable end connectors have been proposed exemplified by U.S. Pat. Nos. 4,648,230 4,779,394 and 5,517,796. While the cross tee connectors of these patent were able to be removed without the use of tools, the removal of the end connectors caused damage to the main tee, both in deformation of the flange of the main tee as well as in deformation of the opening in the main tee for the connection of the connectors.

There thus remains a need for a simple to install cross tee end connector which provides for a secure connection of the cross tees in the suspended ceiling system, while allowing relatively simple removal of the cross tees without damage to the main tee's.

SUMMARY OF THE INVENTION

The present invention in one aspect provides for an end connector for a cross tee for use in a suspended ceiling grid system. The end connector has a generally planar body having a rear mounting portion and a forward connecting tongue portion for insertion into a vertical opening in a web of a main tee. The tongue portion has an upper edge and a lower edge and a main tee web locking means comprising a spring element projecting upwardly from the tongue upper edge and canted at an obtuse angle outwardly of the tongue portion. The spring element has a first forward shoulder with a forwardly sloping front surface and a rearwardly spaced second shoulder having a rearwardly sloping rear surface, the shoulders defining a main tee web receiving notch there between.

In another aspect of the invention, the end connector comprises a front portion adapted to be inserted by a stab in motion into a vertical opening having a transverse slot at its top thereof formed in a web of a main tee and a rear portion adapted to be attached to an end of a cross tee. The front portion has front, bottom and top edges with a first lock arrangement provided on a top edge of the front portion, the first lock region providing a connection between the end connector and a web of a main tee when the connector is inserted into an accepting opening in a web of a main tee. The first lock arrangement extends angularly outwardly of the end connector and has a forward portion resiliently deflectable from its angled rest position toward a horizontal position to pass through an accepting opening in a web of a main tee and then spring back to its rest position. A web containing area is located rearwardly of the forward portion for containing a web of a main tee and a stop surface is located rearwardly of the web containing area. The front portion of the end connector also has a second lock arrangement located within the body of the front portion for locking engagement with a complementary second lock arrangement of another end connector to interlock two such connectors inserted from opposite sides into an accepting opening of a web of a main tee.

In yet another aspect of the invention, the end connector has a generally planar body having a rear mounting portion and a forward connecting tongue portion for insertion into a vertical opening in the web of a main tee. The tongue portion has a first lock arrangement for locking engagement with a web of a main tee and a second lock region comprising an opening in the body of the end connector adjacent a front edge thereof and a cam latch lanced from the body of the connector and extending outwardly thereof. Each of the cam latch and opening are provided with forward and rearward edges, the cam latch of one end connector engaging the opening of another end connector when two such connectors are inserted into an opening of a web of a main tee. The interaction of the forward edge of the cam latch and the rearward edge of the opening maintains the connection under compression situations and the interaction of the rearward edge of the cam latch and the forward edge of the opening maintains the connection under tension situations.

In yet another aspect, the present invention provides for a suspended ceiling grid comprising a plurality of parallel spaced main tees and cross tees interconnected with the main tees at intersections. The main tee includes a web having a vertically extending opening having a horizontally extending portion at the top thereof. The cross tees include end connectors at the end thereof, the end connectors having a front portion projecting into said opening of the main tee web from opposite sides of the main tee and a rear portion attached to the cross tee, the end connectors being inserted into the opening by a stab in motion. The end connectors have a first lock region located at a top edge of each of the end connectors, the first lock region extending angularly outwardly of the end connector and having a forward portion resiliently deflectable from its rest position to pass through the horizontally extending portion at the top of the opening and then spring back to its rest position. A web containing area is located rearwardly of the forward portion first lock portion for containing the web of a main tee and a stop surface is located rearwardly of the web containing area. The front portion of the end connector also has a second lock region located within the body of the front portion for locking engagement with a complementary second lock region of another end connector to interlock two such connectors inserted from opposite sides into an opening of a web of a main tee.

In yet another aspect, the present invention provides for an end connector for a cross tee, the end connector having a generally planar body having at its forward upper edge a torsion spring locking formation inclined at an obtuse angle to the planar body and deflectable towards a horizontal position. The arrangement is such that the locking spring formation interlocks by a stab in motion with a web of a main tee having a vertical slot with a horizontally extending section at the top.

In yet another aspect, the present invention provides for an end connector for a cross tee, the end connector having a generally planar body with a forward tongue portion for insertion into an opening in a main tee and a rear portion for attachment to a cross tee. The tongue portion has a horse shoe shaped reinforcing rib formation having a vertical section adjacent the connector rear portion and spaced longitudinal horizontal legs extending to adjacent the forward edge of the tongue portion. A lock formation is provided within the horse shoe shaped rib formation for locking engagement with a corresponding end connector when two such end connectors are inserted from opposite sides into a main tee web opening. The lock formation comprises a rearwardly facing T shaped keeper formation cut out adjacent the forward edge of the tongue and having a forward vertical head section and a short rearwardly extending body section. A pair of ribs project to one side of the planar body bordering the top and bottom of the cut out T shaped keeper formation to provide spaced forwardly facing keeper shoulders at opposite sides of the T shaped keeper formation. A rearwardly facing bird shaped latch member is lanced out of the tongue portion and projects on the opposite side of the tongue to the pair of ribs. The latch member has a rearwardly extending inclined ramp centered on but having a width less than the width of the body section of the cut out T shaped keeper formation. The ramp leads up to a pair of arched wings connected at their tips to the tongue and defining a pair of latch shoulders for engagement with the keeper shoulders of a corresponding end connector.

BRIEF DESCRIPTION OF THE DRAWINGS

Preferred embodiments of the present invention are illustrated in the drawings, in which.

DETAILED DESCRIPTION OF THE PREFERRED EMBODIMENTS

Figure 1:
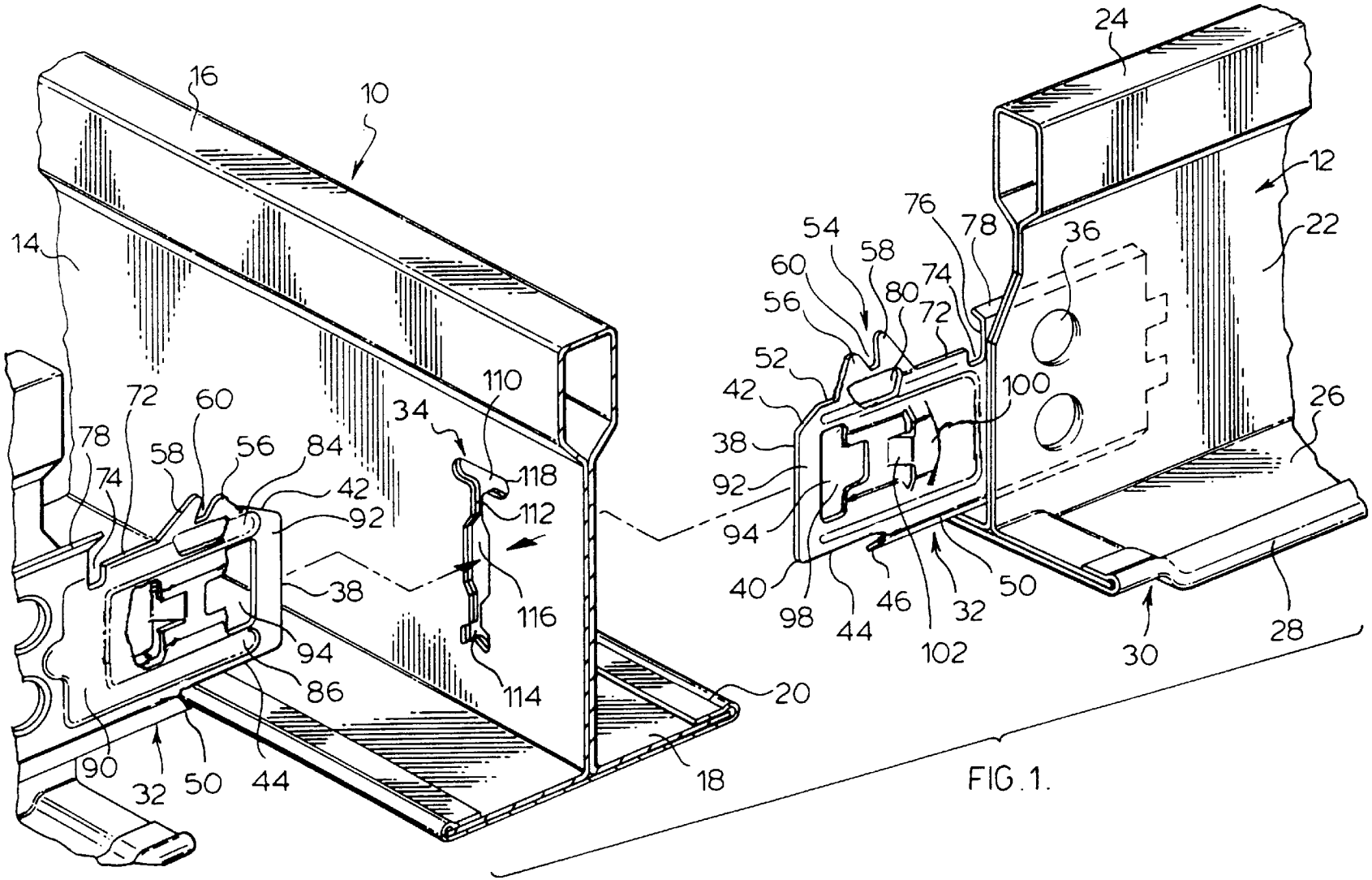
FIG. 1 is a perspective view of an opposed pair of cross tee's having a first embodiment of end connectors according to the present invention aligned with the opening in a main tee.
Figure 2:
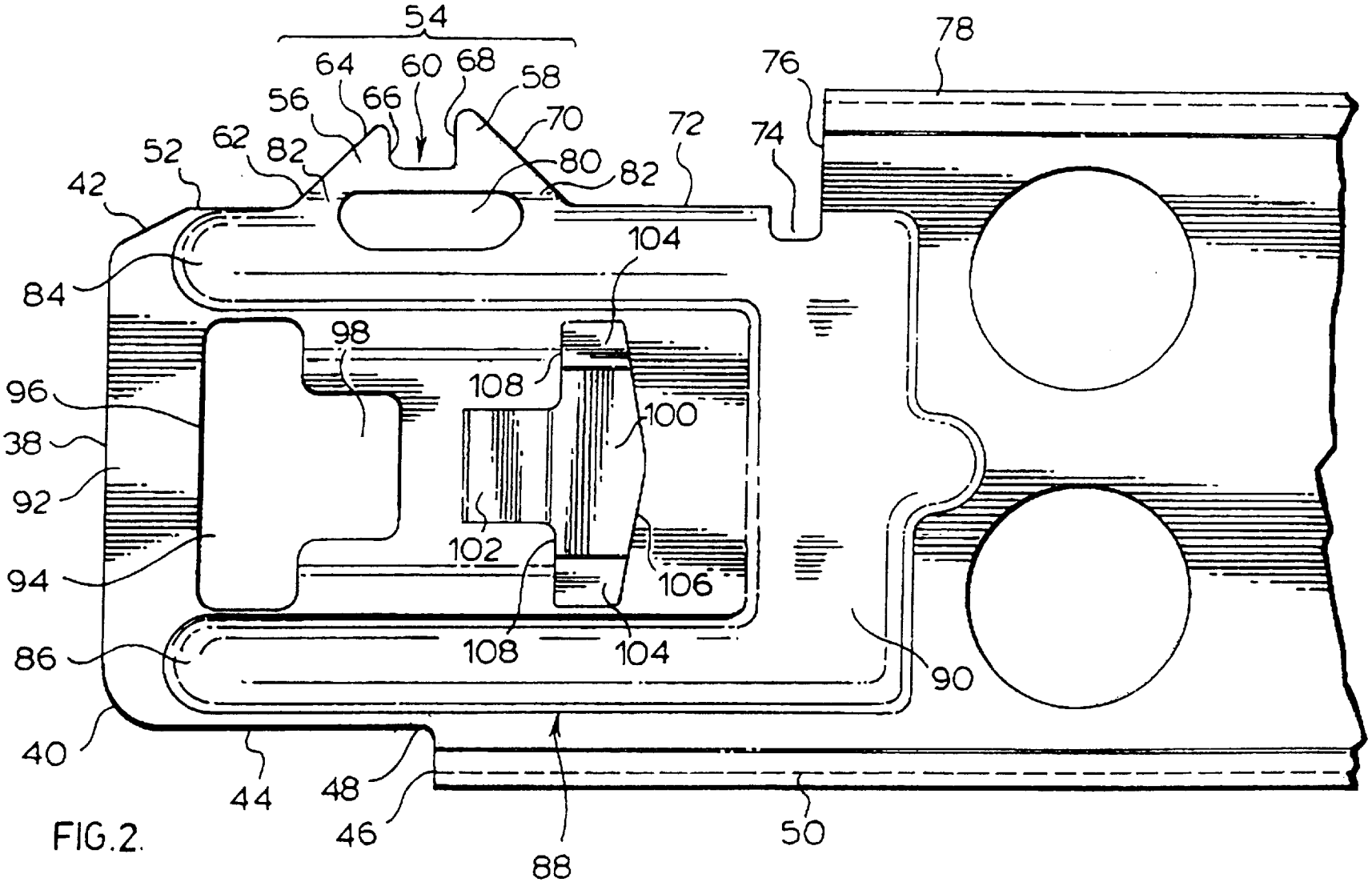
FIG. 2 is an enlarged side elevation view of the end connector of FIG. 1.

A first preferred embodiment of a suspended ceiling grid system, according to the present invention is illustrated in FIGS. 1 through 8. The ceiling grid system comprises main tee's, or runners 10, and cross tee's or runners 12 interconnected together to form a ceiling grid in a typical suspended ceiling installation. The main tees 10 are formed in a typical manner, being bent from a suitable metal stock to form a central web 14 with a stiffening bead or bulb 16 extending along the top edge of the web 14. The main tee is also provided with flanges 18 extending from the lower edge of the web 14. A cap stock 20 is provided to overlie the flange 18 to provide a finished surface which is visible from the interior of the room in which the suspended ceiling is installed.

Similar to the main tees 10, the,cross tee's or runners 12 are provided with a central web 22, a stiffening bead or bulb 24, flanges 26 and cap stock 28. The end 30 of the flange 26 and cap stock 28 of the cross tee 12 is offset upwardly to permit the end 30 of the flange 26 of the cross tee 12 to rest on top of the flange 18 of the main tee 10 when the cross tee's 12 are installed with the main tee's 10.

Each of the cross tees 12 is provided with end connectors 32 which pass through an opening 34 in the web 14 of the main tee 10 so that the connectors of opposing cross tees engage with one another and provide for a ceiling grid construction. End connectors have a "handedness" in that the second end connector to be installed in the opening can be installed to the right hand side or left hand side of the first end connector. The end connector 32 shown in the attached figures are "right handed" but "left handed" connectors are also part of the present invention.

In most applications, the main tees are installed in a parallel spaced apart relationship with the main tees spaced four feet apart. Four foot long cross tees are installed between the main tees every two feet along the main tees to provide the standard two foot by four foot opening. Some suspended ceiling grids are installed to provide two foot by two foot openings. In these installations, two foot long sub-cross tees are provided and installed between the four foot long cross tees centered between the main tees. There are other types of ceiling grid patterns including basket weave where the cross tees are interconnected. The end connector of the present invention is usable with all such ceiling grid constructions.

As illustrated in the figures, end connector 32 is connected to the web 22 of the cross tee 12 at the rear portion of the end connector by means of rivets 36. End connector 32 is provided with a number of stiffening regions as will be explained herein below to increase the stiffness of the connector 32. As shown, particularly in FIG. 2, connector 32 is provided with a front or forward tongue portion for insertion into the opening 34 of the web 14 of the main tee 10. Front portion is provided with a generally vertical front edge 38 with a rounded lower corner 40 and an inclined upper corner 42 to aid in the insertion of the connector 32 into the opening 34 of the main tee 10. The lower edge 44 of the front portion of the connector 32 extends rearwardly from the rounded corner 40 to a stop 46. The junction between the lower front edge 44 and the stop 46 is preferably provided with a rounded cut-out 48 so that as the die used to punch out the end connector 32 wears the dimension of the end connector 32 for rotation of the web 14 of the main tee 10 during dismantling will be maintained relatively constant. Rearwardly of the stop 46, the connector is preferably provided with an outwardly inclined lower edge 50 to provide for stiffening of the connector 32.

The front upper edge 52 of the front portion of end connector 32 extends rearwardly from the inclined upper corner 42 to a first lock arrangement 54. The first lock arrangement 54 is provided as a pair of shoulders 56 and 58 defining a web receiving region 60 between them. The forward shoulder 56 has a rearwardly inclined front edge 62 leading to a rounded over top region 64 and a generally vertical rear edge 66, leading to the generally "U" shaped region 60 for containing the web 14 of the main tee 10 when the connector is inserted into the opening 34 of the main tee 10, as will be explained further below. The rear of the U shaped opening 60 is defined by the rearward shoulder 58 which acts as a stop. Rear shoulder 58 is provided with a front edge 68 which is essentially perpendicular to the base of the U 60 and of a height to provide for positive engagement with the web 14 of the main tee 10 when the connector 32 is inserted in the opening 34. The height of the rear shoulder 58 also aids in torsionally restraining the main tee 10 and enhances the ability of the main tee 10 to support torsionally eccentric loads exerted by certain infill material such as light fixtures. The height of the rear shoulder 58 also helps inhibit accidental disassembly of the connection such as when light fixtures are dropped in at an angle. The rear edge 70 of the rear shoulder 58 is a downwardly sloping arrangement leading to a rear upper edge 72 of the front portion of the end connector 32. The rear upper edge 72 extends to a generally U shaped parking opening 74, the purpose of which will be explained further herein below. A stop surface 76 extends above the parking opening 74 to butt against the web 14 of the main tee 10 when the end connector 32 connections are being dismantled. The upper edge 78 of the rear portion of the end connector 32 rearward of the stop 76 is provided as an inclined edge for further stiffening of the end connector 32.

The end connector 32 is provided with an opening 80 below the first lock arrangement 54. Preferably, this opening 80 extends to either side of and slightly upwardly into the first lock arrangement 54 to provide the first lock arrangement 54 as a strap bridging the opening 80. The first lock arrangement 54 is inclined outwardly from the end connector 32 by bending along lines 82 extending from the upper front edge 52 and upper rear edge 72 to the edges of the opening 80. Preferably, the first lock arrangement 54 is inclined outwardly at a 45° angle from the end connector 32. This outward inclination of the first lock arrangement 54 as well as the strap configuration provides the first lock arrangement 54 as a torsion spring for ease of installation of end connector 32 into the opening 34, as will be explained further below. This torsion spring aspect of the first lock arrangement 54 also aids in the removal of the end connector 32 from the opening 34, as will also be explained further below.

End connector 32 is provided with horizontally extending stiffening regions 84 and 86 adjacent the upper edge 52 and lower edge 44. Preferably, stiffening regions 84 and 86 are provided as the legs of a generally U or horseshoe shaped stiffening rib 88 embossed in the body of the connector. The legs 84 and 86 of the stiffening rib 88 are adjacent the upper 52 and lower 44 edges of the end connector 32, respectively, with the base 90 vertically spanning the end connector 32. The stiffening rib 88, in addition to providing stiffness to the end connector 32 also aids in properly locating the opposed end connectors 32 within the opening 34 of the main tee 10. The legs 84 and 86 of the stiffening rib 88 are provided with a slight forward taper from about a position in generally vertical alignment with the web containing opening 80 to the forward end of the legs 84 and 86. In this way, the thickness of the legs 84 and 86 increases from the front to about the area of the first lock arrangement 54. Beyond the first lock arrangement 54 the thickness of the legs 84 and 86 is maintained. The tapering of the legs 84 and 86 enables the end connector 32 to easily slide into the opening 34, particularly if the end connector 32 being installed is the second one in the opening 34. As the end connector 32 is being inserted into the opening 34, the tapering of the legs 84 and 86 causes them to gradually fill the width of the opening 34 to aid in locating the end connectors 32 in their proper side by side relationship to maintain their interconnection.

End connector 32 is also provided with a second lock arrangement to interlock two end connectors 32 together when they are installed in their side by side relationship in the opening 34 of the web 14 of the main tee 10. The front of the end connector 32 has a front strap 92 located between the front edge 38 of the end connector 32 and an opening 94 in the body of the end connector 32. The opening 94 has a vertical front edge 96 and at the rear edge is provided with a rearwardly extending reduced section 98 to result in the opening 94 having a rearwardly facing T shaped keeper formation. End connector 32 is provided with a rearwardly facing lanced out cam latch 100 which is spaced laterally from the body of the end connector 32 and attached to the body of the end connector 32 by a cam surface 102 at the forward edge of the cam latch 100 and ramps 104 at the side edges. The rearwardly facing edge 106 of the cam latch 100 has a shallow V shape to provide a birds mouth connection for part of the second lock arrangement. The shaping of the cam latch 100 gives it a bird shaped appearance with the cam surface 102 providing a tail like ramp, the wings including ramps 104 being attached at their tips to the end connector and the V shape of the rearward edge 106 forming a central rearward facing peak.

The web 14 of the main tee 10 is provided with an opening 34 through which the end connectors 32 of the cross tees 12 are installed. As shown in the figures, particularly FIGS. 3 and 4, the opening 34 has a horizontally extending slot 110 at the top, a vertically extending central portion 112 and a slightly enlarged bottom region 114. The central area of the vertically extending portion 112 of the opening 34 is preferably provided with an enlarged region 116 to aid in allowing the end connector 32 to pass therethrough during installation. The width of the vertically extending portion 112 above and below the enlarged region 116 is of a dimension to permit two end connectors 32 in a side by side relationship to be contained therewithin. The top portion of the opening is an elongated, horizontal slot 110 having rounded ends 118. The slot 110 is of a length to permit the first lock region 54 of the end connector 32 to pass therethrough when dismantling, as will be explained further below. The bottom portion 114 is slightly enlarged and of a dimension to permit the inclined lower edge 50 of the end connector 32 to pass therethrough when dismantling the connector, as will be explained further below.

Figure 3:
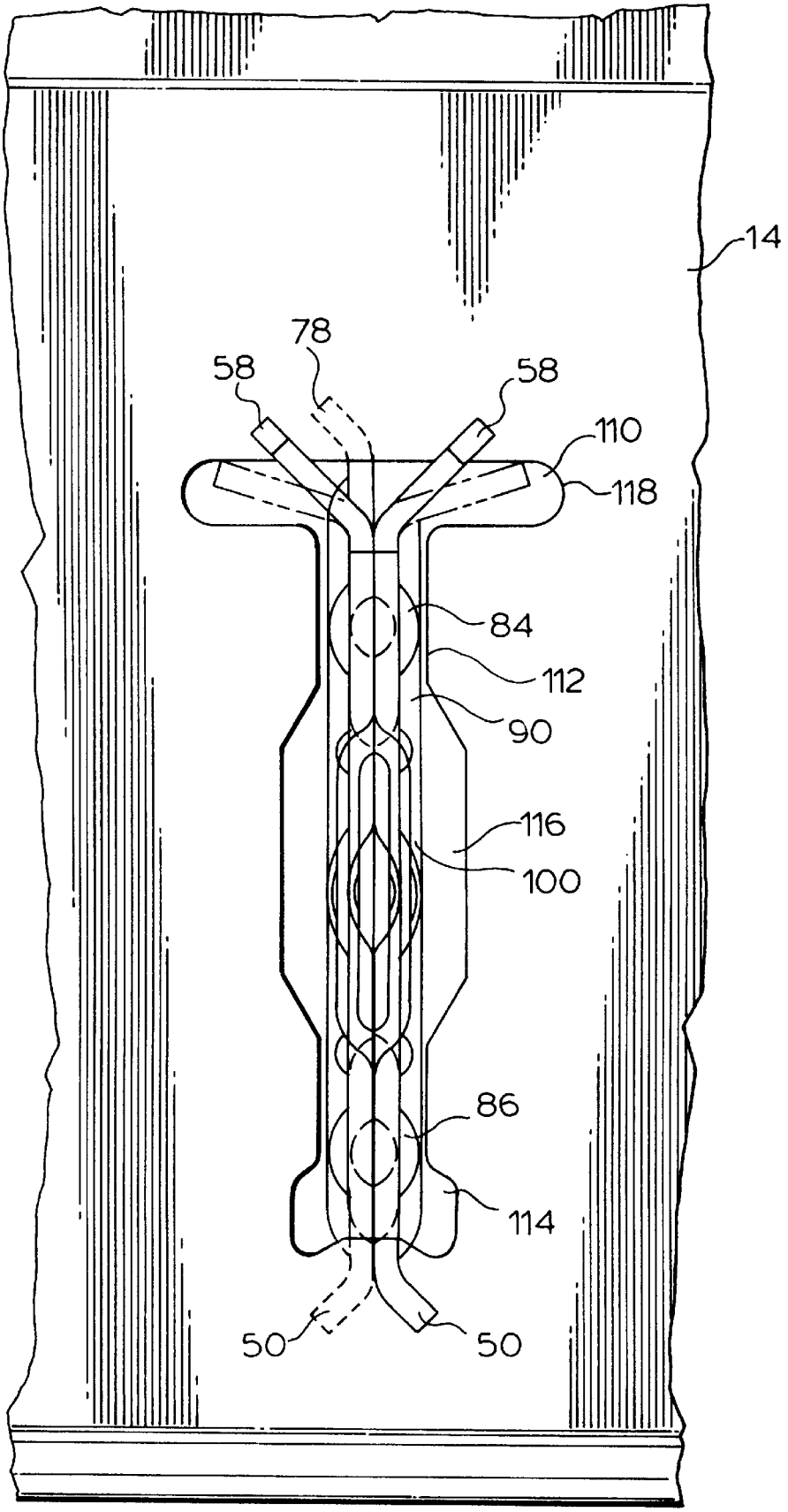
FIG. 3 is a front view in cross section through the parking notch of one end connector of a pair of cross tee's according to FIG. 1 installed in the opening of a main tee.
Figure 4:
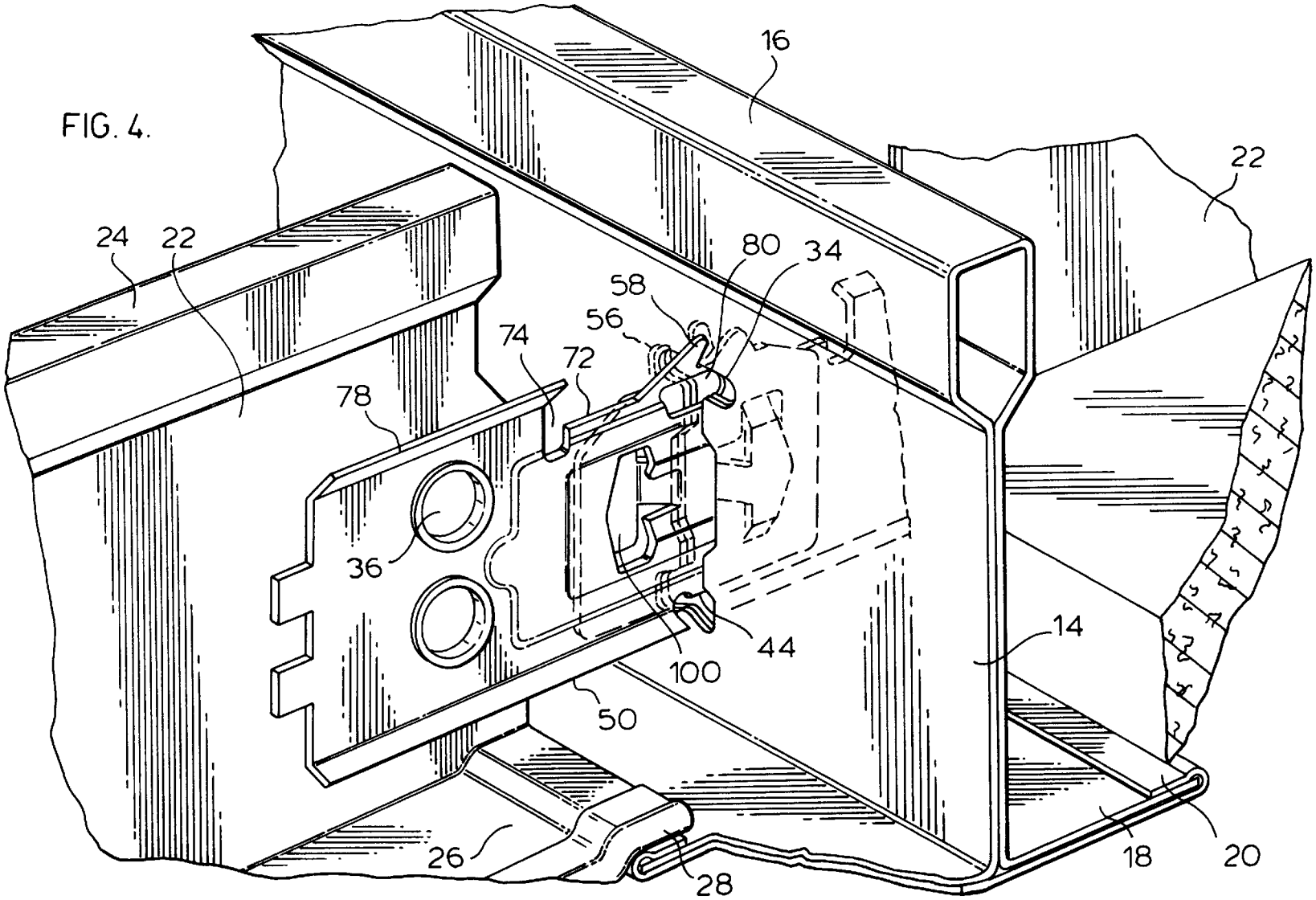
FIG. 4 is a front perspective showing the end connectors of FIG. 1 installed in the opening of the main tee.

The ceiling grid system of the present invention is installed in the following manner as illustrated in particular in FIGS. 1, 3 and 4. As in the standard practice, the main tees 10 are suspended from the building structure by suitable hanger wires attached to the bulb or bead 16 or web 14 of the main tee 10 in the conventional manner. The main tees 10 are generally installed in a parallel spaced apart relationship with the main tees 10 spaced four feet apart. A cross tee 12 is installed in the ceiling grid system by a stab in motion of the end connector 32. The installer inserts the end of the end connector 32 in the opening 34 of the web 14 of the main tee 10. The connector is then pushed forwardly in a horizontal linear manner until the first lock arrangement 54 engages the web 14 of the main tee 10. As the end connector 32 is being pushed forwardly into the opening 34, the inclined front edge 62 of the front shoulder 56 the first lock arrangement 54 contacts the top edge of the horizontally extending slot 110 of the opening 34. The inclined front edge 62, rides along the top edge of the horizontally extending slot 110 and owing to the torsion spring nature of the first lock arrangement 54, the first lock arrangement 54 is biased downwardly toward a horizontal position until the rounded over top 64 of the front shoulder 56 of the first lock arrangement 54 passes through the opening 34. At this time, the first lock arrangement 54 springs back and the web 14 of the main tee 10 slides over and past the rounded over top 64 and is contained within the U shaped opening 60. The front edge 68 of the rear shoulder 58 and the stop 46 at the lower region of the end connector 32 butt up against the surface of the web 14 of the main tee 10 above and below the opening 34. When only one end connector 32 of a cross tee member 12 is installed in the opening 34, the cross tee member 12 can be supported in cantilever fashion by the stop 46 contacting the surface of the web 14 of the main tee 10 below the opening 34 and the web 14 of the main tee 10 above the opening 34 being contained within the U shaped opening 60 of the first lock arrangement 54. This permits the cross tee member 12 to be supported until the end connector 32 on the opposite end of the cross tee can be inserted into its opening 34.

As noted above, a second end connector 32 is thereafter inserted into the opening 34 to the opposite side of the main tee 10 from the first end connector 32. As the second end connector 32 is being inserted into the opening, the first lock arrangement 54 of the second end connector 32 is biased downwardly similar to the situation with the first end connector 32. In addition, the front edges 38 of each of the end connectors 32 contact the inclined cam surface 102 of the lanced out cam latch 100 of the opposing end connector 32, being part of the second lock arrangement, and the front straps 92 flex sideways as well as bowing slightly to allow them to slide up and over the inclined cam surfaces 102 and the lanced out cam latch 100. Once the front edge 38 and the front strap 92 have passed over the lanced out cam latch 100, the front strap 92 drops down and the lanced out cam latch 100 of each end connector is contained within the opening 94 at the front of the opposing end connector 32 with the inclined cam surface 102 contained within the rearwardly extending reduced section 98 of the opening 94. This provides for the second lock arrangement for lockingly engaging the two end connectors 32 inserted in the opening 34 from opposite sides of the web 14. The V shaped rearward edge 106 of the cam latch 100 of one end connector 32 engages the front edge 96 of the opening 94 of the other end connector 32 in a birds mouth arrangement to provide for secure connection of the two end connectors 32 in tension situations. The front edges 108 of the cam latch 100 of one end connector 32 above and below the cam surface 102 bear against the rear upper and lower edges of the opening 94 of the second end connector 32 above and below the rearwardly extending reduced section 98 to provide secure connections in compression situations.

As noted above and illustrated in FIGS. 3 and 4, the legs 84 and 86 of the stiffening rib 88 aid in properly locating the end connectors 32 within the opening 34 of the main tee 10 to maintain the second lock arrangement to interlock the two end connectors 32. When the two end connectors 32 are installed in the opening 34 and interlocked in the manner described above, the legs 84 and 86 of the stiffening rib 88 extend outwardly from the body of the end connectors 32 to bear against the sides of the opening 34 and prevent accidental disengagement of the second lock arrangements.

Figure 5:
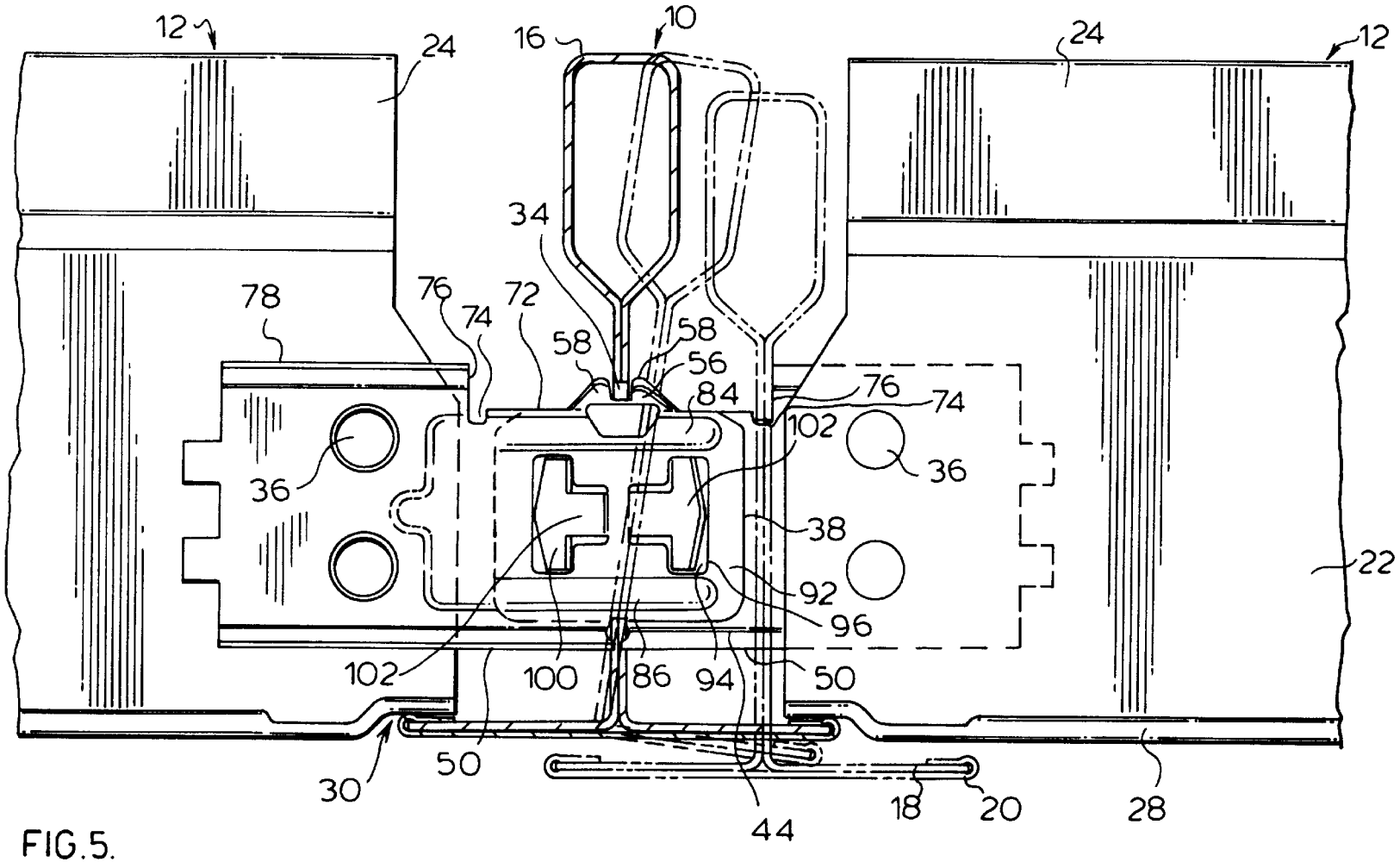
FIG. 5 is a broken away side elevation view of the cross tees and a main tee according to FIG. 1 in the process of removal of the cross tee end connectors.
Figure 6:
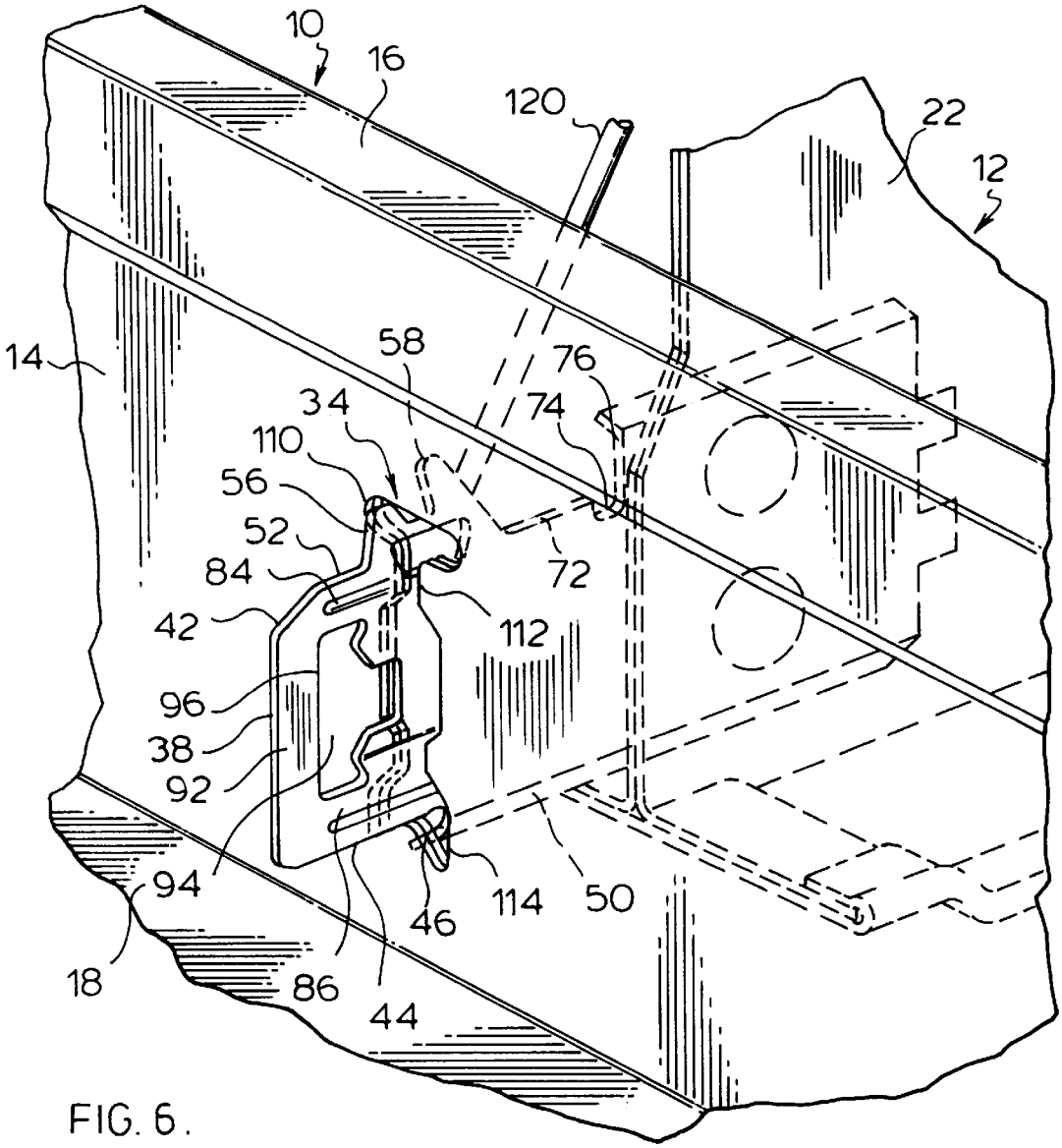
FIG. 6 is a perspective view of the first step in the removal of a cross tee end connector.
Figure 7:
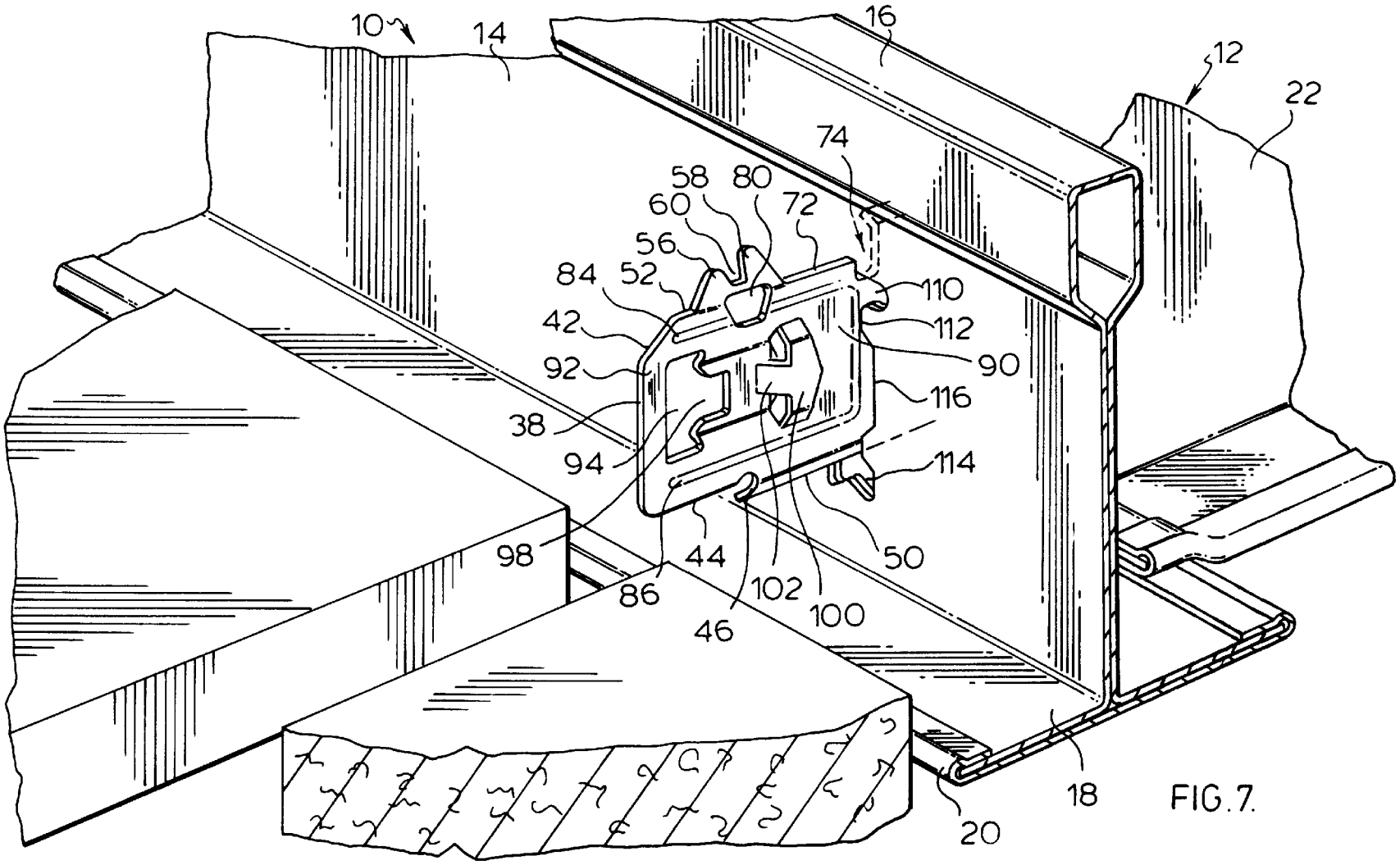
FIG. 7 is a perspective view of an end connector and a main tee of FIG. 6 in the parked position.
Figure 8:
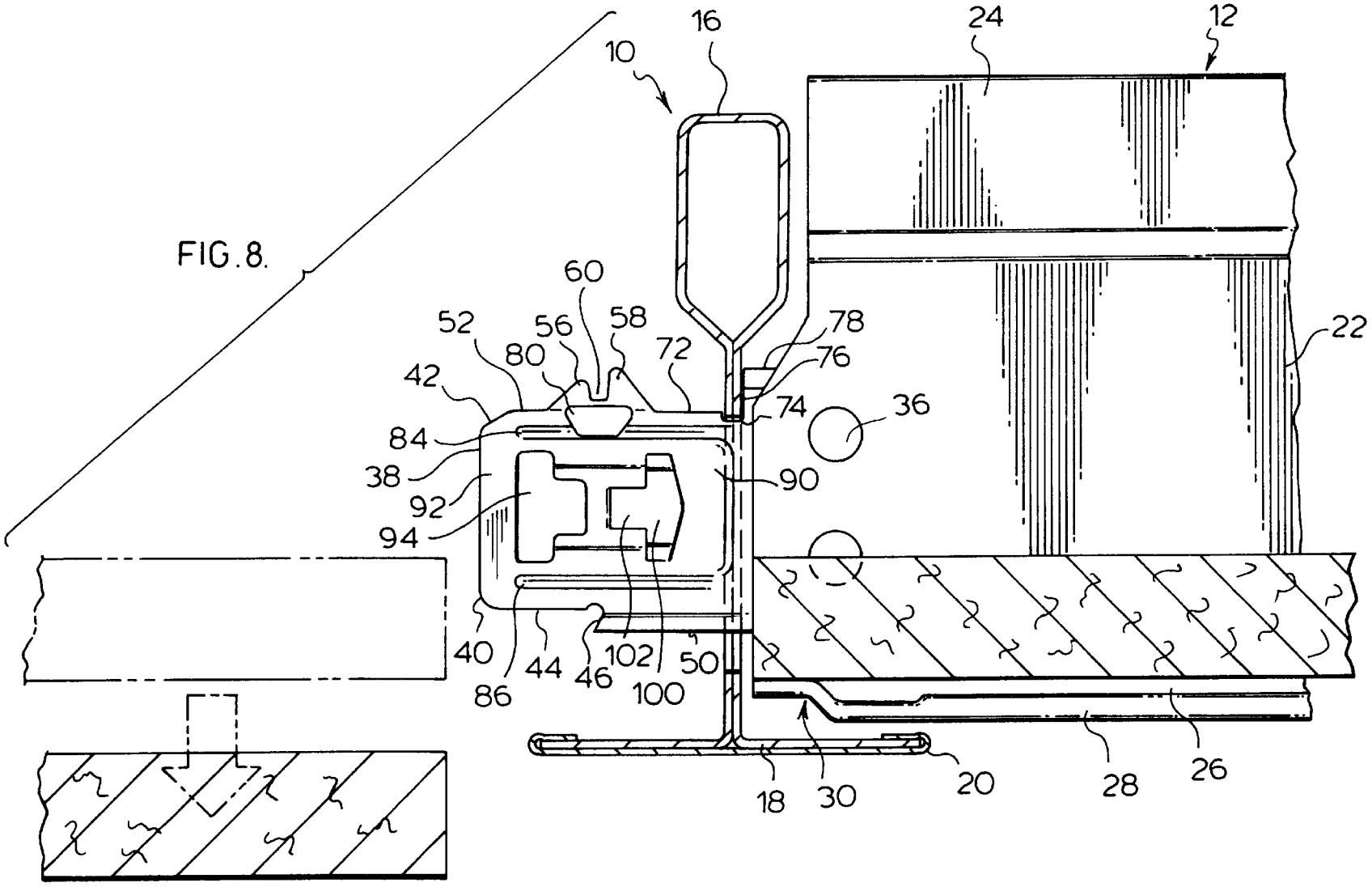
FIG. 8 is a side elevation view of the parked cross connector of FIG. 6.

Should it be necessary to remove one of the cross tees 12 from the ceiling grid system, this is easily accomplished with the end connectors 32 of the present invention as shown in FIG. 5. As illustrated in FIG. 6, the rear shoulder 58 of the end connector 32 of the cross tee 12 opposite the one to be removed is pressed downwardly into a horizontal position by a suitable tool, such as a screw driver 120, etc. Once the rear shoulder 58 approaches a horizontal position such as shown dotted in FIG. 3 it is able to pass through the upper horizontal slot 110 of the opening 34 so that the main tee 10 can be pushed rearwardly of the rear shoulder 58. As the main tee 10 is displaced, the upper edge of the horizontal slot 110 rides up and over the rounded over top region 64 of the front shoulder 56 of the first lock arrangement 54 of the end connector 32 of the cross tee 12 to be replaced, deflecting the first shoulder 56 of the end connector 32 downwardly so that it can pass through slot 110 and does not block the rearward movement of the main tee 10. The rearward movement of the main tee 10 allows the main tee 10 and opening 34 to be lowered down the downwardly sloping rear edge 70 of the depressed rear shoulder 58 thereby lowering the main tee 10 relative to the end connectors 32 until the flange 18 of the main tee 10 clears the flanges 26 of the cross tees 32 and the inclined lower edge 50 of the end connector 32 not to be removed is able to pass through the enlarged bottom portion 114 of the opening 34. The main tee 10 is then pushed laterally rearwardly along the end connector 32 until it contacts the stop 76 of the end connector 32 and the top edge of the horizontal slot 110 of the opening 34 drops down into the parking opening 74 which holds the web 14 of the main tee 10 in position. At this time, the end connector 32 to be removed is completely clear of the opening 34 and the two end connectors 32 may be dismantled from one another by merely laterally moving the end connectors 32 apart.

While the dismantling arrangement, as described above, requires the use of a tool for the initial deflection of the rear shoulder 58, the dismantling of the end connector 32 is easily achieved without permanent damage to the end connector 32, the flanges 18 of the main tee 10, or the opening 34 in the web 14 of the main tee 10.

Once the replacement end connector 32 is brought into side by side relationship with the end connector 32 on which the main tee 10 is parked to engage the complimentary second lock arrangements, the main tee 10 is pushed upwardly to release the top edge of the horizontal slot 110 of the opening 34 from the parking opening 74. The main tee 10 then is pushed back into its proper position and as the top edge of the horizontal slot 110 contacts the inclined rear edge 70 of the rear shoulder 58 of the end connector 32 on which the main tee 10 has been parked and the rounded over top 64 of the first shoulder 56 of the first lock arrangement 54 of the replacement end connector 32, it biases both these members 56 and 58 downwardly until they are aligned with the horizontal slot 110 of the main tee opening 34 whereby they can pass through the slot 110. On further movement of the main tee 10 to clear it past the deflected rear shoulder 58 of the one end connector 32 and the deflected front shoulder 56 of the other end connector 32 they both will spring back and the main tee 10 will be secured in the "U" shaped openings 60 of both end connectors 32. The rear shoulder 58 of the first lock arrangement 54 which was bent by the tool 130 may then be straightened if necessary.

The end connector 32 is preferably stamped from a high strength steel to provide the required strength of the end connector 32 to resist the forces on the end connector 32 during emergency situations such as fire and earthquakes. It is known that during stamping operations, the sides of cuts made in the blank to form the end connector 32 are not perfectly perpendicular. Rather, the sides of the cuts have a slight angle, generally on the order of 10° or less, typically on the order of about 7°.

Figure 9:
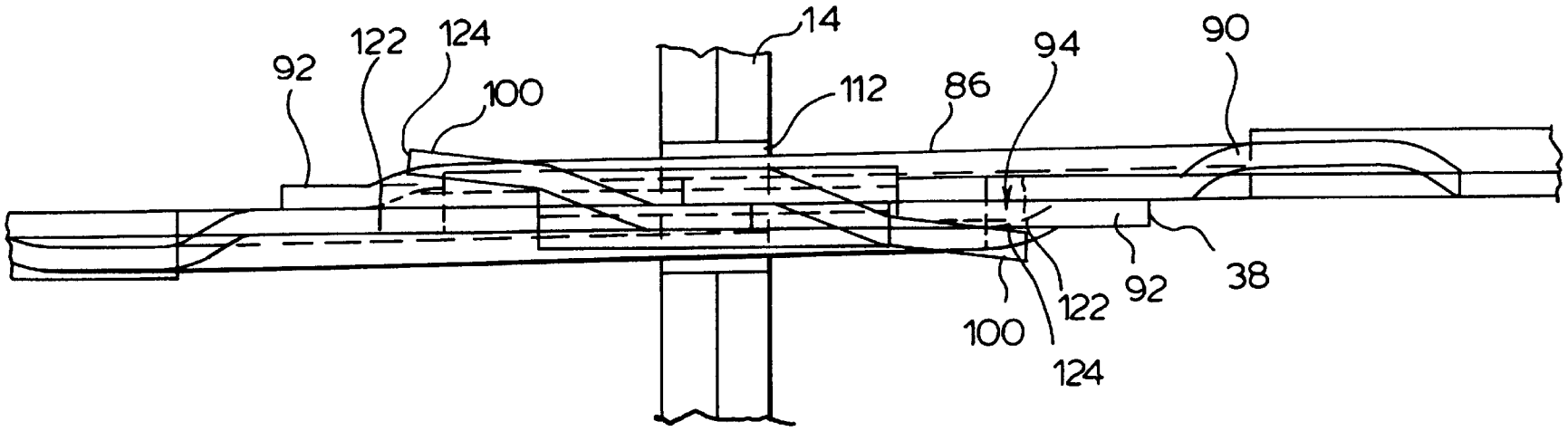
FIG. 9 is a top plan view in cross section through the middle of the end connectors of FIG. 2 installed in the opening.

In a preferred embodiment of the present invention, as illustrated in FIG. 9, the end connector 32 is stamped using dies oriented to take advantage of the slight angle of the wall of the cut. Thus where walls of two cuts interact to form a locking arrangement, such as for example wall 122 of the vertical front edge 96 between front strap 92 and opening 94 and the wall 124 of the rear edge 106 of cam latch 100, the dies are selected to provide for the interacting walls 122 and 124 to have parallel faces. In this way, the surface of interaction between the two walls 122 and 124 is increased as they interact across the entire depth of the cut rather than just at a single line at the top or bottom. In addition, the dies are selected such that the orientation of the angle of the cut is such to increase the engagement of the walls of the cut when put under load. For example, with the second locking arrangement, when the locking arrangement is placed under tension or compression, the interacting surfaces of the walls of the cuts in the locking arrangement are angled to increase the resistance of the locking arrangement to the force.

Figure 10:
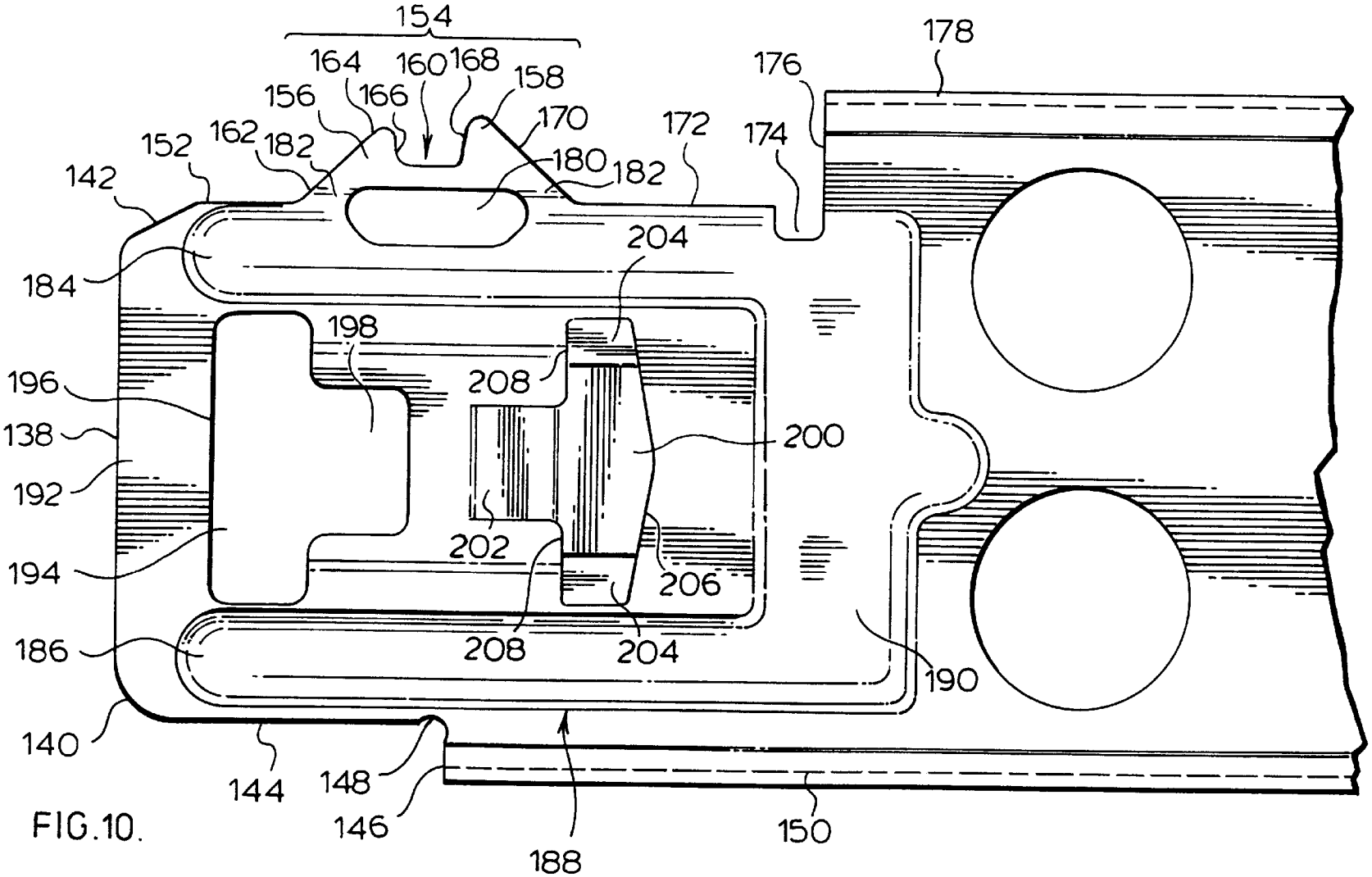
FIG. 10 is an enlarged side elevation view of a second embodiment of an end connector according to the present invention.
Figure 11:
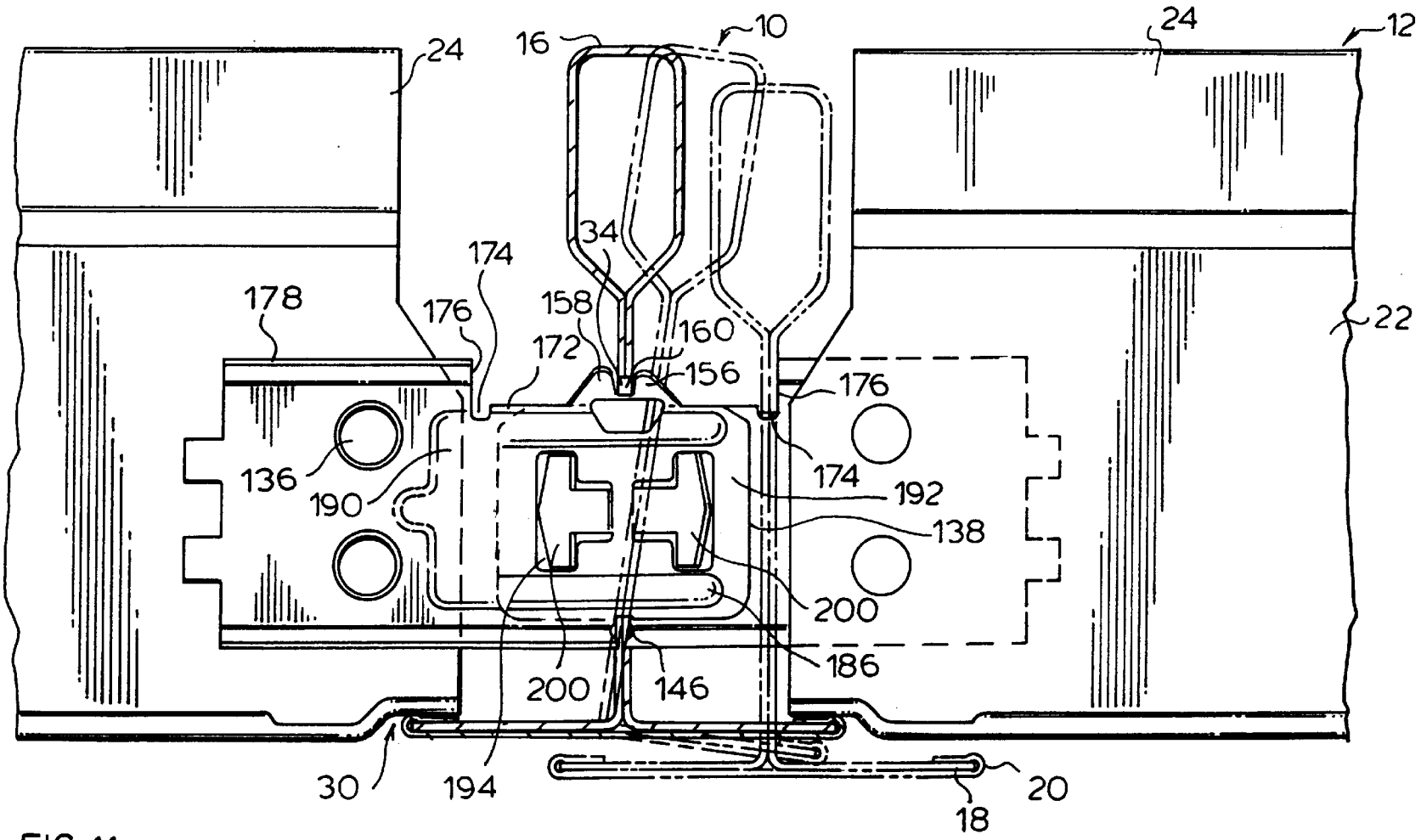
FIG. 11 is a perspective view of the end connector of FIG. 10 in the process of being removed.

A second embodiment of an end connector of the present invention is illustrated in FIG. 10. The end connectors 132 shown in FIG. 10 are identical to the end connectors 32 shown in FIGS. 1 to 8 except for the rear shoulder 158 and the parts of end connector 132 are designated with the numbers 100 higher than those used in describing connector 32. The end connector 132 is provided with a rear shoulder 158 having a rearwardly upwardly inclined front edge 168 leading to a rounded top and a rearwardly sloping rear edge 170. The rear shoulder 158 is also of slightly less height than the rear shoulder 58 of the end connector 32 of the first embodiment. End connector 132 is able to be released from engagement with the main tee web 14 without the use of tools. As illustrated in FIG. 11, this is accomplished by horizontal translation of the main tee 10, relative to the cross tee 12. As pressure is exerted on the main tee 10, the top edge of the horizontal slot 110 rides against the rearwardly sloping front edge 168 of the rear shoulder 158 of one of the end connectors 132 and the rear edge 166 of the front shoulder 156 of the first lock arrangement 154 of the second end connector 132. This biases both the rear shoulder 158 of the one end connector 132 and the first shoulder 156 of the other connector 132 downwardly until they both can pass through the horizontal top slot 110 of the opening 34. At this time, the main tee 10 drops down so that the flange 18 of the main tee 10 clears the flange 26 of the cross tee 12. The main tee 10 is then pushed rearwardly until it contacts the stop 176 and the top edge of the horizontal slot 110 is contained within the parking arrangement 174. Once the cross tee 12 is replaced, the main tee 10 is brought into the proper position in a manner similar to that described above.

The ceiling grid system of the present invention provides for an easy to install cross tee end connector with a simple first lock arrangement for support of the cross tee when one end connector of a cross tee is installed in an opening of a main tee web by a stab in motion. The end connectors are provided with a second locking arrangement which interlocks the end connectors one to the other where they are installed in a side by side relationship from opposite sides of the main tee. The connection of the two end connectors may be easily released from interengagement should it be desirable or necessary to replace one of the connectors in the manner described above.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An end connector for a cross tee for use in a suspended ceiling grid system, said end connector having a generally planar body having a rear mounting portion and a forward connecting tongue portion for insertion into a vertical opening in a web of a main tee, said tongue portion having an upper edge and a lower edge and having a main tee web locking means comprising a spring element projecting upwardly from said tongue upper edge and canted at an obtuse angle outwardly of said tongue portion, said spring element having a first forward shoulder having a forwardly sloping front surface and a rearwardly spaced second shoulder, said shoulders defining a main tee web receiving notch there between.

2. An end connector as claimed in claim 1 wherein said spring element is in the form of a strap bridging an opening formed in said tongue portion below said strap.

3. An end connector as claimed in claim 2 wherein said second shoulder is larger than said first shoulder.

4. An end connector as claimed in claim 3 wherein said first shoulder has a rounded top.

5. An end connector as claimed in claim 4 wherein said second shoulder has a generally vertical front surface to provide a stop surface to abut a main tee web when said main tee web is contained in the web receiving notch.

6. An end connector as claimed in claim 5 further having means to interconnect with a mating end connector when the connectors are inserted into a main tee opening from opposite sides.

7. An end connector as claimed in claim 6 wherein the end connector is provided with at least one horizontally extending stiffening rib located adjacent at least one of the upper and lower edges.

8. An end connector as claimed in claim 7 wherein the stiffening rib tapers inwardly from a position generally in vertical alignment with the main tee web locking means to a forward edge of the stiffening rib.

9. An end connector as claimed in claim 8 wherein the stiffening rib is provided as a U shaped stiffening rib with legs extending adjacent the upper and lower edges.

10. An end connector as claimed in claim 9 wherein the means to interconnect with a mating end connector is located between the legs of the stiffening rib.

11. An end connector for a cross tee for use in a suspended ceiling grid system, the end connector comprising a front portion adapted to be inserted by a stab in motion into an accepting vertical opening having a transverse slot at a top thereof formed in a web of a main tee and a rear portion adapted to be attached to an end of said cross tee, the front portion having front, bottom and top edges, a first lock region provided on said top edge of the front portion, the first lock region providing a connection between the end connector and said web of said main tee when the connector is inserted into said accepting opening in said web of said main tee, the first lock region extending angularly outwardly of the end connector and having a forward portion resiliently deflectable from an angled rest position toward a horizontal position to pass through said accepting opening and then spring back to the rest position, a web containing area located rearwardly of the forward portion for containing said web of said main tee and a stop surface located rearwardly of the web containing area, the front portion of the end connector also having a second lock region located within a body of the front portion for locking engagement with a complementary second lock region of another end connector to interlock two said connectors inserted from opposite sides into said accepting opening of said web of said main tee.

12. An end connector as claimed in claim 11 wherein the forward portion of the first lock region has a front inclined edge which provides a camming surface to deflect the first lock region to permit the forward portion to pass through said accepting opening in said web of said main tee and thereafter spring back to the rest position.

13. An end connector as claimed in claim 12 wherein the stop surface of the first lock region has a generally vertical surface for engaging a surface of said web of said main tee when the end connector is inserted into said accepting opening of said web of said main tee.

14. An end connector as claimed in claim 13 wherein the second lock region comprises an opening in the body of the end connector adjacent the front edge thereof and a cam latch lanced from the body of the connector and extending outwardly thereof, the cam latch of the end connector being adapted to be contained within the body opening of an opposing end connector when two connectors are inserted on opposite sides into said accepting opening of said web of said main tee.

15. An end connector as claimed in claim 14 wherein the body opening and the cam latch have edges at an angle such that the angle of the edges is aligned when the cam latch of the connector engages the body opening of the opposing end connector.

16. An end connector as claimed in claim 15 wherein the end connector is provided with at least one horizontally extending stiffening rib located adjacent one of the top and bottom edges.

17. An end connector as claimed in claim 16 wherein the stiffening rib tapers inwardly from a position generally in vertical alignment with the web containing area to a forward edge of the stiffening rib.

18. An end connector as claimed in claim 17 wherein the stiffening rib is provided as a U shaped stiffening rib with legs extending adjacent the top and bottom edges.

19. An end connector as claimed in claim 18 wherein the body opening and cam latch of the second lock region are located between the legs of the stiffening rib.

20. An end connector for a cross tee for use in a suspended ceiling grid system, said end connector having a generally planar body having a rear mounting portion and a forward connecting tongue portion for insertion into a vertical opening in a web of a main tee, said tongue portion having a first lock arrangement for locking engagement with said web of said main tee and a second lock region comprising an opening in the body of the end connector adjacent a front edge thereof and a cam latch lanced from the body of the connector and extending outwardly thereof, the cam latch and body opening being provided with forward and rearward edges, the cam latch of the end connector being contained within the body opening of another end connector when two connectors are inserted into said opening of said web of said main tee wherein the interaction of the forward edge of the cam latch and the rearward edge of the body opening maintaining the connection under compression situations and the interaction of the rearward edge of the cam latch and the forward edge of the body opening maintaining the connection under tension situations.

21. An end connector as claimed in claim 20 wherein the edges at the body opening and the cam latch have an angle such that the edges are in abutment throughout their depth when the cam latch of the connector engages the body opening of a second end connector.

22. An end connector as claimed in claim 21 wherein the end connector is provided with at least one horizontally extending stiffening rib located adjacent one of the upper and lower edges of the tongue portion.

23. An end connector as claimed in claim 22 wherein the stiffening rib tapers inwardly from a position generally in vertical alignment with the first lock arrangement to a forward edge of the stiffening rib.

24. An end connector as claimed in claim 23 wherein the stiffening rib is provided as a U shaped stiffening rib with legs extending adjacent the upper and lower edges of the tongue portion.

25. An end connector as claimed in claim 24 wherein the second lock region is located between the legs of the stiffening rib.

26. A suspended ceiling grid comprising a plurality of parallel spaced main tees and cross tees interconnected with said main tees at intersections, each of the main tees including a web having a vertically extending opening having a horizontally extending portion at a top thereof, each of the cross tees having an end connector at an end thereof, each of the end connectors having a front portion, first and second ones of said cross tees having the connector front portions thereof projecting into one of said openings of one of the main tee webs from opposite sides of said one of the main tee webs, each end connector having a rear portion attached to one of the cross tees, the end connectors being inserted into the openings by a stab in motion, a first lock region located at a top edge of each of the end connectors, said first lock region extending angularly outwardly of the end connector and having a forward portion resiliently deflectable from a rest position to pass through the horizontally extending portion at the top of said openings and then spring back to the rest position, a web containing area located rearwardly of said forward portion for containing the web of one of the main tees and a stop surface located rearwardly of the web containing area relative to said front portion, the front portion of each end connector also having a second lock region located within the front portion for locking engagement with said second lock region of another end connector to interlock two said connectors inserted from opposite sides into the opening in one of the webs.

27. A suspended ceiling grid as claimed in claim 26 wherein the forward portion of the first lock region has a front inclined edge which provides a camming surface to deflect the first lock region to permit the forward portion to pass through the top horizontally extending portion of one of the openings in the web of one of the main tees and thereafter spring back to the rest position.

28. A suspended ceiling grid as claimed in claim 27 wherein the stop surface of the first lock region has a generally vertical surface for engaging the surface of the web of one of the main tees when the end connector is inserted into the opening of the web of one of the main tees.

29. A suspended ceiling grid as claimed in claim 28 wherein the second lock region comprises an opening in the front portion of the end connector adjacent the front edge thereof and a cam latch lanced from the front portion of the connector and extending outwardly thereof, the cam latch of one said end connector being contained within the front portion opening of another said end connector when two said connectors are contained within the opening of the web of one of the main tees.

30. A suspended ceiling grid as claimed in claim 29 wherein the body opening and the cam latch have edges at an angle such that the angle of the edges is aligned when the cam latch of one connector engages the opening of a second end connector.

31. A suspended ceiling grid as claimed in claim 30 wherein the first lock region of each connector is deflectable downwardly to allow the stop surface to pass through the top horizontal portion of the vertical opening and allow the web of one of the main tee to move laterally rearwardly of the stop surface of the end connector until a second opposed one of said end connectors is clear of the web opening whereby the cross tee having the second end connector may be removed from the ceiling grid.

32. A suspended ceiling grid as claimed in claim 31 wherein each of the end connectors is provided with a notch intermediate the front and rear portions to releasably hold the web of one of the main tees when the main tee is moved rearwardly of the stop surface and clear of the second end connecter.

33. A suspended ceiling grid as claimed in claim 32 wherein each of the end connectors is provided with at least one horizontally extending stiffening rib located adjacent one of the top and bottom edges of the front portion of the end connector, the stiffening rib also aiding in maintaining opposite ones of the end connectors in a side by side arrangement in the opening of the web of one of the main tees.

34. A suspended ceiling grid as claimed in claim 33 wherein the stiffening rib tapers inwardly from a position generally in vertical alignment with the web containing area to a forward edge of the stiffening rib.

35. A suspended ceiling grid as claimed in claim 34 wherein the stiffening rib is provided as a U shaped stiffening rib with legs extending adjacent the top and the bottom edges.

36. A suspended ceiling grid as claimed in claim 35 wherein the body opening and cam latch of the second lock region are located in the legs of the stiffening rib.

37. An end connector for a cross tee, said end connector having a generally planar body having at a forward upper edge thereon a torsion spring locking formation inclined at an obtuse angle to said planar body and deflectable towards a horizontal position, the arrangement being such that said spring locking formation interlocks by a stab in motion with a web of a main tee having a vertical slot with a top and with a horizontally extending section at the top.

38. An end connector as claimed in claim 37 in which said connector is further provided with a locking formation for interlocking with a corresponding end connector when two said end connectors are introduced into the main tee slot from opposite sides of the main tee.

39. An end connector for a cross tee, said end connector having a generally planar body with a forward tongue portion for insertion into an opening in a main tee and a rear portion for attachment to said cross tee, said tongue portion having a horse shoe shaped reinforcing rib formation having a vertical section adjacent said connector rear portion and spaced longitudinal horizontal legs extending to adjacent a forward edge of said tongue portion, a lock formation within said horse shoe shaped rib formation for locking engagement with a corresponding end connector when said end connectors are inserted from opposite sides into said main tee web opening, said lock formation comprising a rearwardly facing T shaped keeper formation cut out adjacent the forward edge of said tongue portion and having a forward vertical head section and a short rearwardly extending body section, a pair of ribs projecting to one side of said planar body bordering a top and a bottom of said cut out T shaped keeper formation to provide spaced forwardly facing keeper shoulders at opposite sides of said T shaped keeper formation, a rearwardly facing bird shaped latch member lanced out of said tongue portion and projecting from said tongue portion opposite to said pair of ribs, said latch member having a rearwardly extending inclined ramp centered on but having a width less than a width of said body section of said cut out T shaped keeper formation, said ramp leading up to a pair of arched wings connected at their tips to said tongue portion and defining a pair of latch shoulders for engagement with the keeper shoulders of a corresponding end connector.

40. An end connector as claimed in claim 39 in which forward edges of said wings have a taper towards a central rearwardly facing peak.

41. An end connector as claimed in claim 40 in which said tongue portion is resilient allowing for lateral deflection.

42. An end connector as claimed in claim 41 in which said tongue portion is capable of being bowed.

43. An end connector as claimed in claim 39 in which the horse shoe shaped rib formation projects to the same side of the body as said ribs bordering said top and bottom of said T shaped cut out keeper formation.

44. An end connector as claimed in claim 39 in which said end connector rear portion has edge flanges projecting in the same direction as said horse shoe shaped rib formation.

45. An end connector as claimed in claim 39 in which said spaced longitudinal horizontal legs of said horse shoe shaped reinforcing rib formation taper in height towards said forward edge of said tongue portion.

* * * * *